US005229824A

United States Patent [19]

Tsusaka et al.

[11] Patent Number: 5,229,824

[45] Date of Patent: Jul. 20, 1993

[54] DEVELOPER MATERIAL SUPPLYING DEVICE FOR INTEGRAL TYPE PROCESSING UNIT ASSEMBLED IN ELECTROPHOTOGRAPHIC TYPE IMAGE RECORDING APPARATUS

[75] Inventors: Shusaku Tsusaka; Hitoshi Nakai; Yasushi Okabe; Soichiro Nishimura, all of Nagoya, Japan

[73] Assignee: Brother Kogyo Kabushiki Kaisha, Nagoya, Japan

[21] Appl. No.: 911,915

[22] Filed: Jul. 10, 1992

[30] Foreign Application Priority Data

| | | | |
|---|---|---|---|
| Jul. 17, 1991 | [JP] | Japan | 3-204056 |
| Aug. 3, 1991 | [JP] | Japan | 3-194585 |
| Aug. 30, 1991 | [JP] | Japan | 3-069485[U] |
| Oct. 25, 1991 | [JP] | Japan | 3-279749 |

[51] Int. Cl.[5] ..... G03G 15/06

[52] U.S. Cl. ..... 355/260; 141/383; 141/386; 222/DIG. 1; 355/245

[58] Field of Search ..... 355/260, 245, 200, 202, 355/210; 141/311 R, 383, 386, 387, 391; 222/DIG. 1

[56] References Cited

U.S. PATENT DOCUMENTS

| | | | |
|---|---|---|---|
| 4,972,887 | 11/1990 | Hacknauer et al. | 355/260 X |
| 4,997,016 | 3/1991 | Hacknauer et al. | 355/260 X |

FOREIGN PATENT DOCUMENTS

| | | | |
|---|---|---|---|
| 0104070 | 5/1988 | Japan | 355/260 |
| 0071170 | 3/1991 | Japan | 355/260 |

*Primary Examiner*—A. T. Grimley
*Assistant Examiner*—Matthew S. Smith
*Attorney, Agent, or Firm*—Oliff & Berridge

[57] ABSTRACT

An integral type processing unit has a photosensitive drum, a developing unit for forming a developer toner image on the photosensitive drum, and a cleaning unit for scraping off residual toners from the drum. The developing unit does not have sufficient internal volume for accumulating therein the developer toners whose amount meet with the service life of the other components. Therefore, toner containers are replaceably attached to the developing unit for supplementing the developer toners therein. In order to limit the replacement times of the toner containers, each of the toner containers are provided with a segment separable therefrom. Further, a receiving segment is provided at the developing unit engageable with the separable segment. The receiving segment has a predetermined number of receiving portions. If all receiving portions are filled with the separable segments, it becomes no longer possible to further replace the toner container with a new container.

12 Claims, 14 Drawing Sheets

DEVELOPER MATERIAL SUPPLYING DEVICE FOR INTEGRAL TYPE PROCESSING UNIT ASSEMBLED IN ELECTROPHOTOGRAPHIC TYPE IMAGE RECORDING APPARATUS

BACKGROUND OF THE INVENTION

The present invention relates to a developer material supplying device, and more particularly, to a dry type developer material supplying device for use in an electrophotographic type image recording apparatus such as a copying machine, a printer and a facsimile.

A Karlson type electrophotographic type processing unit has conventionally been used in an image recording apparatus. As shown in FIG. 1, the processing unit 1 generally includes a photosensitive drum 2, a primary charger 3, a developing unit 5, and a cleaning unit 10. The photosensitive drum 2 serves as a latent image carrier, and the primary charger 3 is adapted for uniformly charging the photosensitive drum 2. An opening 4 is formed at an outer frame la of the processing unit for introducing light from a light source (not shown) and modulated by image signals and for scanning the modulated light onto the photosensitive drum 2 for forming an electrostatic latent image thereon as indicated by an arrow A in FIG. 1. The developing unit 5 is adapted for providing a visible developer toner image corresponding to the latent image on the drum 2. To this effect, developer toners 8 are accumulated in the unit 5, and a developing roller 6 and a blade 7 are provided. The developing roller 6 is adapted for providing developer toners on the photosensitive drum 2, and the blade 7 is adapted for regulating a, thickness of the developer toners to be formed on the drum 2. The image recording apparatus (not shown) to which the processing unit 1 is assembled is provided with a transferring charger 6 for transferring the developer toner image on the photosensitive drum 2 onto a printing sheet (not shown). In this case, residual developer toners may be remained on the photosensitive drum 2. Therefore, the cleaning unit 10 scrapes the residual toner from a surface of the drum 2 and collects the thus scraped toners 9 in the cleaning unit. The cleaning unit 10 has a waste toner container 11.

Apparently, in accordance with the numbers of the image recording operation, developer toners 8 in the developing unit 5 are gradually consumed. On the other hand, residual toners on the drum 2 is gradually accumulated in the waste toner container 11 of the cleaning unit 10. Further, the photosensitivity and chargeability of the photosensitive drum 2 may be gradually degraded in accordance with the repeated image recording operation. In this connection, these expendable must be replaced with a new one or must be supplemented at every given numbers of image recording operation. Thus, recently, a so called integral type processing unit is widely available in which the above described various components and units are integrally housed in a one unit in order to facilitate replacement work and to avoid leakage of the developer toners at the time of the replacement work.

The integral type processing unit is designed such that service life of the photosensitive drum 2, used-up period of the developer toners 8 in the developing unit 5 and the fully accumulating period of the wasted toners 9 in the cleaning unit 10 are approximately coincident with one another. Obviously, the used-up period of the toner 8 is determinative by an internal volume of the developing unit 5, and fully accumulating period of the wasted toners 9 is determinative by an internal volume of the container 11. If these units reach their service lives, a new processing unit is assembled into the image recording apparatus instead of the old processing unit to facilitate the replacement work thereof.

However, the integral type processing unit incurs problems because of the improvement in the photosensitive drum 2. That is, according to a recent improvement in an organic photosensitive compound (OPC) as the photosensitive material, the photosensitive drum can provide much prolonged service life capable of performing 10,000 to 20,000 times image recording operation in case the drum has an outer diameter of 30 mm. Even though the developer toner consumption amount is dependent on the developing mode, 600 grams of the developer toners may be roughly required for conducting 10,000 times image recording operation under an employment of a single component type magnetic toners and print area ratio of 5%. In this case, the internal volume of the developing unit 5 must be 1,000 cc provided that the toners have bulk density of 0.6.

In an attempt to provide consistency between the service life of the photosensitive drum with the used-up period of the developer toners 8, the toner containing volume of the developing unit 5 must be increased. Thus, resultant processing unit becomes bulky, which in turn lower the handling ability of the processing unit and image recording apparatus must correspondingly be bulky.

To avoid this problem, an independent toner container is provided which is assembleable into the integral type processing unit. A toner container is replaceable with a new toner container by several times. Therefore, required amount of toners can be supplemented several times into the processing unit until the photosensitive drum 2 and the cleaning unit 10 reach their service lives.

Still however, the toner supplement system may provide another problems in that the toner container can be replaced with a new toner container without any restriction. Accordingly, if new toners are supplemented into the processing unit for image recording operation, whereas the photosensitive drum and the cleaning unit 10 reach their service lives. Through the image recording operation, the photosensitive drum no longer provide its photosensitivity due to fatigue of a charger wire or degradation of the photosensitive surface. Alternatively, the waste toner container 11 is full of waste toners, which in incapable of cleaning operation, otherwise the waste toner may be leaked out of the container 11, and therefore, the image recording apparatus and printing sheet may be contaminated with the waste toners.

SUMMARY OF THE INVENTION

In order to overcome the above described disadvantages, an inhouse proposal has been made in which toner supplementing times are detected or displayed as shown in FIG. 2. According to the inhouse proposal, there are provided a developing unit DU provided with a counter 42 which counts replacement times of a toner container TC. The counter includes a ratchet wheel (not shown) and a display window 42. The toner container TC is provided with a pawl 41. If the toner container TC is mounted on the developing unit DU, the pawl 41 is brought into engagement with the ratchet wheel for angularly rotating the latter by a predetermined amount. This one step rotation is visible through the window 42 which displays replacement times. If the toner container TC is replaced by predetermined times corresponding to the service life of the processing unit, an operator can acknowledge the replacement timing of the entire processing unit.

However, if the operator does not have sufficient knowledge about the indication through the window 42, or if the operator forcibly replaces the toner container with a new container in spite of the full rotation of the ratchet wheel, new toners are supplied into the processing unit which has been matured into its service life. Therefore, the above described problems has not yet been completely solved.

Therefore, it is an object of the present invention to overcome the above described drawbacks and disadvantages, and to provide an improved developer material supplying device for use in an processing unit of an image recording apparatus.

Another object of the invention is to provide such developer material supplying device capable of prohibiting new supply of the developer material into the processing unit if service life thereof has already been expired.

These and other objects of the present invention will be attained by providing a developer material supplying device for supplying a developer material to a processing unit available for electrophotographic printing, the processing unit having an outer frame for accommodating therein a photosensitive drum having a given service life, a developing unit and a cleaning unit having a service life approximately the same as that of the photosensitive drum, the supplying device comprising (a) a developer material container replaceably coupled to the developing unit for supplying the developer material to the developing unit, numbers of the replacements being determinative by the service life of the photosensitive drum and the cleaning unit, (b) fixing means for fixing the developer material container to the developing unit, (c) an engagement segment provided at the developer material container, the engagement segment being separable from the container upon application of a force, and (d) receiving means fixed to the processing unit, the receiving means being engageable with the engagement segment when the developer material container is fixed to the developing unit, and the engagement segment being separable from the developer material container and remainable within the receiving means when the developer material container is disassembled from the developing unit.

BRIEF DESCRIPTION OF THE DRAWINGS

In the drawings;

FIG. 4(*b*) is a bottom view showing the toner container according to the first embodiment;

FIG. 7(*b*) is a cross-sectional view showing the engaging manner of the tongue piece with respect to the holding segment according to the first embodiment;

FIG. 7(*c*) is a cross-sectional view showing retention of the tongue piece within the holding segment even after the decoupling of the toner container from the developing unit according to the first embodiment;

DETAILED DESCRIPTION OF THE PREFERRED EMBODIMENTS

Figure 3:
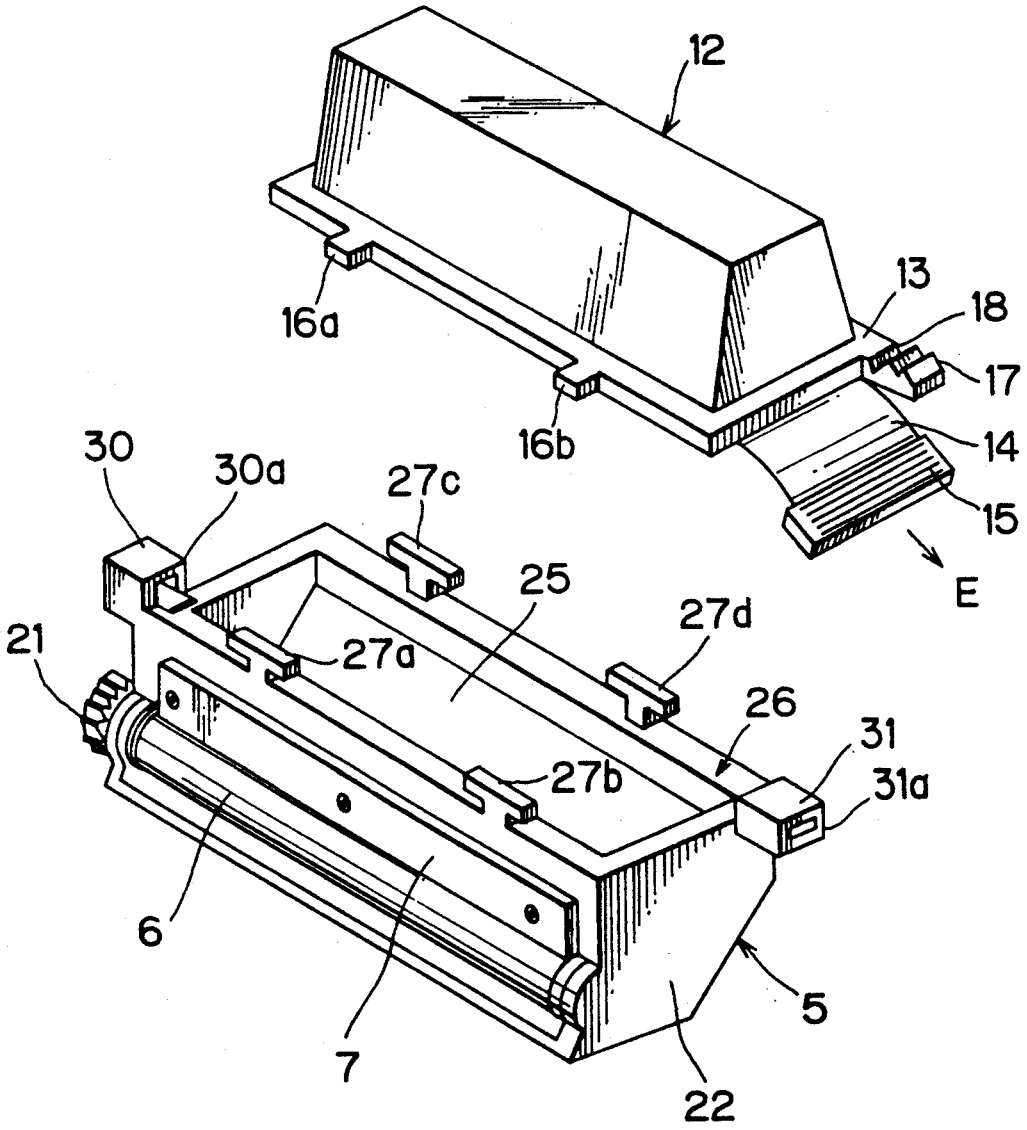
FIG. 3 is a schematic view showing a toner container and a developing unit engageable therewith according to the first embodiment of this invention.

A developer toner feeding device according to a first embodiment of this invention will be described with reference to FIGS. 3 thru 7(*c*). The developer toner feeding device generally includes a toner container 12 and a developing unit 5 as best shown in FIG. 3. The toner container 12 has a rectangular or trapezoid cross-section whose lower portion is opened. The container 12 is produced by injection molding to have a wall thickness of 1 to 3 mm and is formed of thermoplastic resin such as polystyrene (PS) and modified polyphenylene oxide (M-PPO).

Figure 7A:
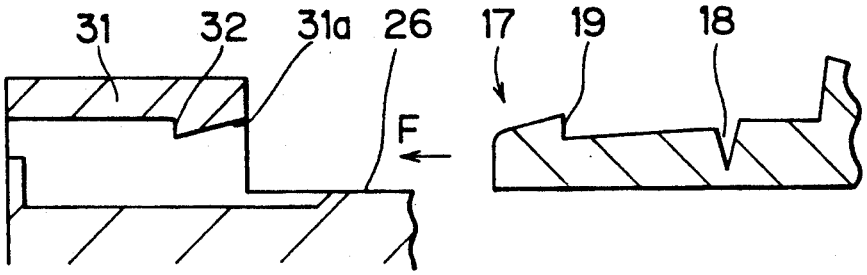
FIG. 7(*a*) is a cross-sectional view for description of a tongue piece of the toner container and holding segment of the developing unit prior to assembly.
Figure 7B:
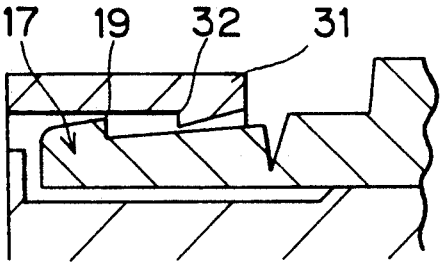
Figure 7C:
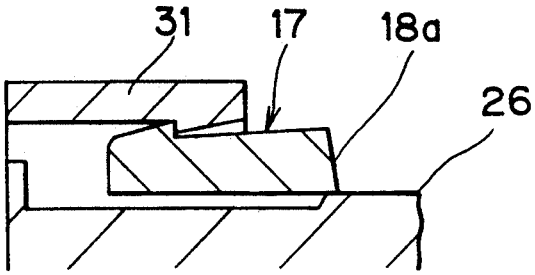

The lower open end of the container 12 is adhesively sealed with a flexible film 14 for accumulating the developer toners in the container 12. The film 14 is made of low density polyethylene (LDPE) and polyethylene terephthalate (PET) and has a thickness of 50 to 200 microns. One end of the sealing film 14 is provided with a knob 15 formed of a resin at a position outside the lower open end of the container 12. Further, the lower open end is integrally provided with outwardly extending flange 13 at four sides, and preferably four projections 15*a*, 16*b*, 16*c* and 16*d* extend from the flange 13 for engagement with the developing unit 5 in order to fix the container 12 to the developing unit 5. The invention, however, is applicable to two projections. Furthermore, a tongue piece 17 protrudes from one corner portion of the lower open end in a longitudinal direction of the container 12. The tongue piece 17 is formed with a notch 18 extending in widthwise direction of the container and between parallel sides of the tongue piece 17. The tongue piece 17 is also formed with a stepped portion 19 at a tip end portion thereof as best shown in FIG. 7(*a*).

Figure 1:
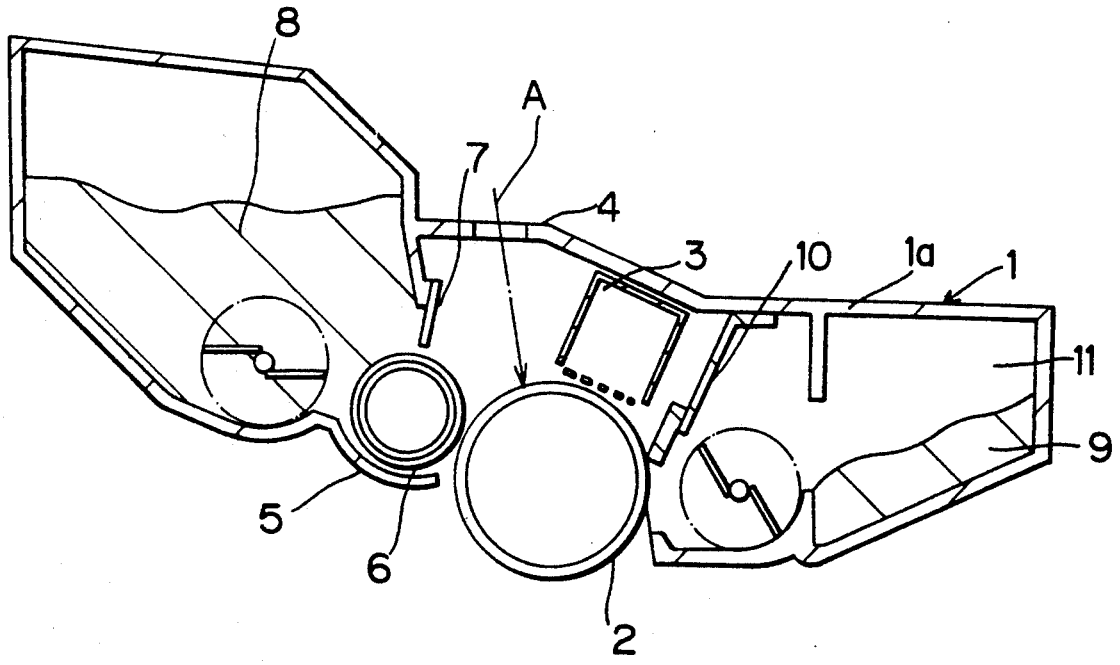
FIG. 1 Prior Art
FIG. 1 is schematic cross-sectional view showing a conventional integral type processing unit.
Figure 2:
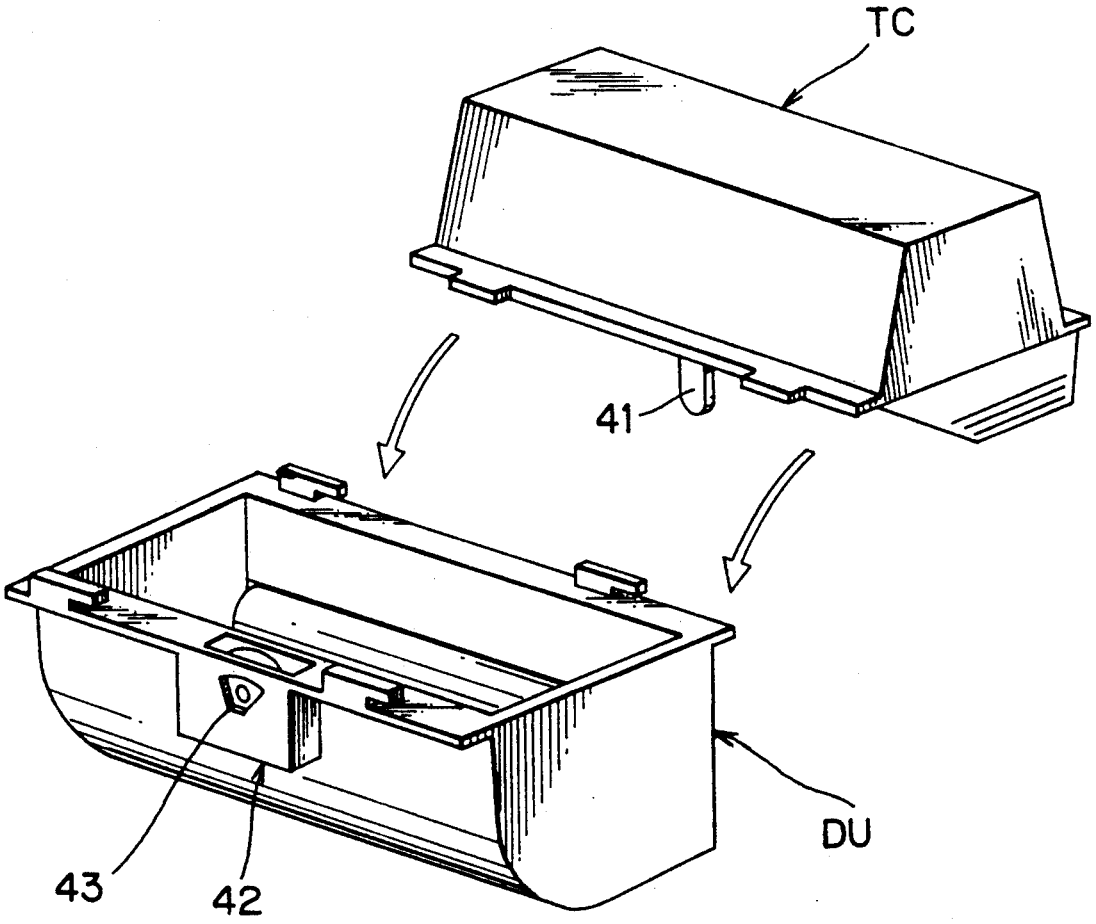
FIG. 2 Related Art
FIG. 2 is a perspective view showing a developer material container and a developing unit according to an inhouse proposal.

The developing unit 5 includes an integral casing 22, a developing roller 6 rotatably supported by the casing 22 for providing developer toners on the photosensitive drum (see drum 2 of FIG. 1). The developing unit 5 also includes a blade 7 for regulating a thickness of a toner layer to be formed on the photosensitive drum, and a gear 22 drivingly rotatable by a drive source (not shown) for rotating the developing roller 6 about its axis. The casing 22 is produced by injection molding to have a thickness of 2 to 4 mm, and is formed of a thermoplastic resin such as polystyrene (PS), acrylonitrile-butadiene (ABS) and modified polyphenylene oxide(M-PPO).

Figure 4A:
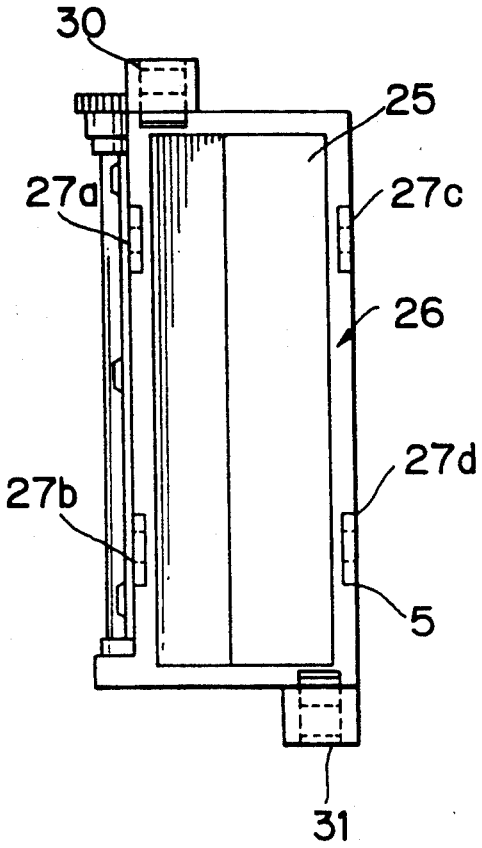
FIG. 4(*a*) is a plan view showing the developing unit according to the first embodiment.
Figure 4B:
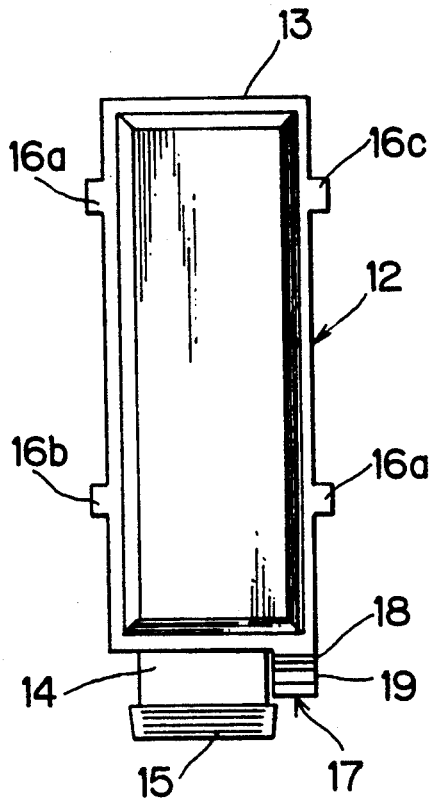
Figure 5:
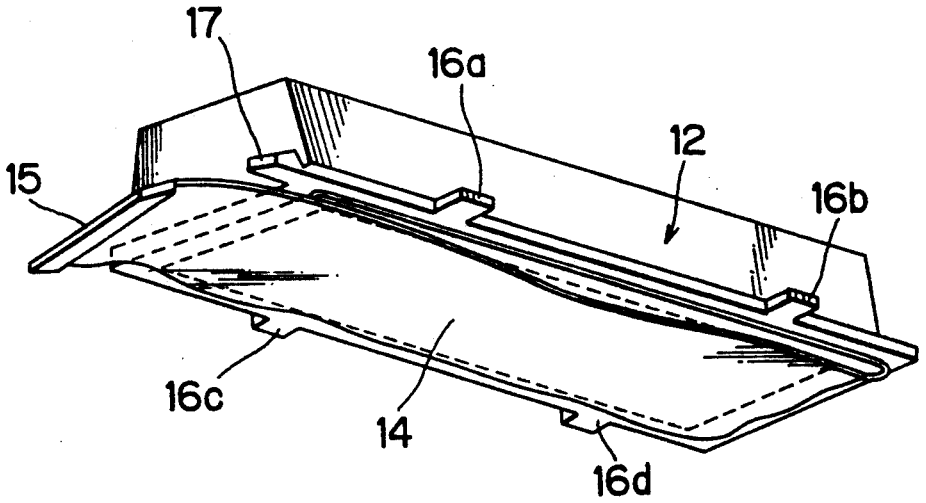
FIG. 5 is a perspective view showing the toner container according to the first embodiment.

The casing 22 has an upper open end 26 at which an open space 25 is defined for receiving developer toners from the toner container 12, and a first set of holding segments preferably four 27*a*, 27*b*, 27*c* and 27*d* projecting from the upper open end and engageable with the projections 16*a*, 16*b*, 16*c* and 16*d*, respectively for fixing the container 12 to the casing 22. The invention, however, is applicable to two segments. The holding segments 27*a* and 27*b* are provided at one longitudinal side (major side) of the open end, and the holding segments 27*c* and 27*d* are provided at another longitudinal side of the open end. Further, a second set of holding segments 30 and 31 are provided at minor sides of the upper open end of the casing 22. Each of the second set of holding segments 30 and 31 is formed with a hole 30*a*, and 31*a*, selectively engageable with the tongue piece 17 of the toner container 12. These second set of holding segments 30 and 31 are positioned in rotational symmetry as best shown in FIG. 4(*a*) with respect to a center of the open space 25. Thus, the toner container 12 can be engageable with the developing unit 5 in one and opposite longitudinal orientation.

Each of the holes 30*a* and 31*a* is formed with a tapered section whose thickness is gradually increased inwardly, and a stepped portion 32 is defined at an inner end of the tapered section. Thus, the stepped portion 19 of the tongue piece 17 is lockingly engageable with the stepped portion 32 as best shown in FIG. 7(*a*). Each bottom of the hole 30*a* and 31*a* of the second set of holding segments 30 and 31 is formed with a recessed portion 31*b* (30*a* is show in FIG. 6) so that the bottom is positioned slightly lower than an upper end face 26 of the developing unit 5. Since the tongue piece 17 is bendable at the thinnest portion, that is, at the notched portion 18, in a case where the tongue piece 17 is inserted into the hole 31*a*, the tongue piece 17 is gradually deformed downwardly when the piece 17 is moved past the tapered section as best shown in FIG. 7(*b*). Thus, the stepped portion 19 is brought into engagement with the stepped portion 32. Incidentally, a positional relationship between the projections 16*a*, 16*b*, 16*c*, 16*d* and the first set of the holding segments 27*a*, 27*b*, 27*c*, 27*d* is determined in such a manner that these projections are engageable with the corresponding first set of holding segments by suitably sliding the toner container 12 in the longitudinal direction after the tongue piece 17 has been engaged with the one of the second set of the holding segments 30 and 31.

With the structure thus organized, if the toner container 1 is firstly installed on the developing unit 5, the container 12 is oriented in a direction shown in FIG. 3 or can be oriented in opposite direction, since the tongue piece 17 can be engageable with one of the second set of holding segments 31 and 30 because of their rotationally symmetrical arrangement. Assuming that the tongue piece 17 is to be engaged with the holding segment 31 as shown in FIG. 3, the tongue piece 17 is firstly inserted into and engaged with the hole 31*a* of the holding segment 31. Then, the lower end face of the toner container 12 is slidingly moved on the upper end face 26 of the developing unit 5, so that the projections 16*a*, 16*b*, 16*c*, 16*d* are brought into engagement with the corresponding first set of the holding segments 27*a*, 27*b*, 27*c*, 27*d*. Thus, the toner container 12 is coupled to the developing unit 5.

Then, the knob 15 is pulled in a direction indicated by an arrow E in FIG. 3, so that the sealing film 14 is peeled off from the lower end face of the toner container 12. Accordingly, developer toners in the container 12 can be supplied into the casing 22 of the developing unit 5.

Figure 6:
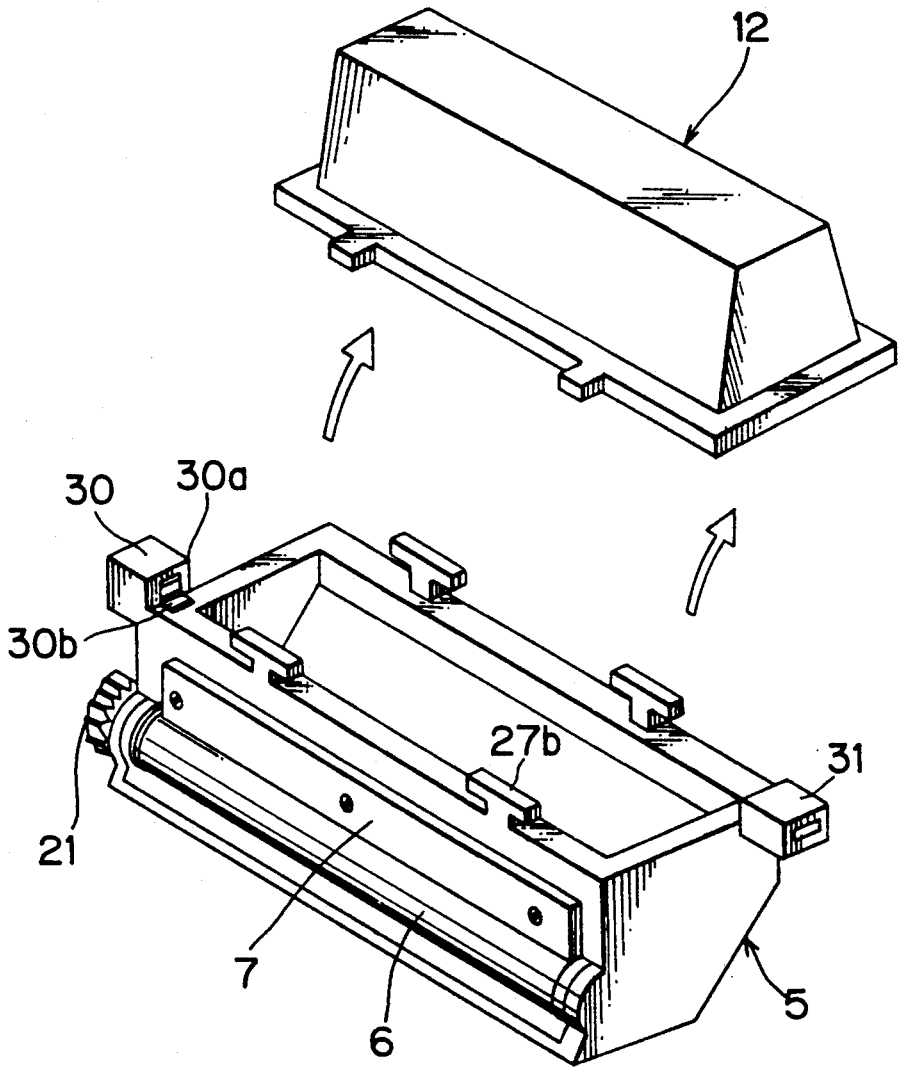
FIG. 6 is a perspective view showing a state in which the toner container is decoupled from the developing unit according to the first embodiment.

In accordance with the repeated image recording operation, toners in the casing 22 is consumed and new toners must be supplemented into the casing 22. Normally, the image recording apparatus is provided with a conventional toner sensor by way of a detection of a change in capacitance due to decrease in the toner amount or by way of the detection of pressure change through an actuator. With this sensor, a toner empty signal is transmitted and the toner empty state may be displayed. Accordingly, an operator can be notified of necessity for supplementing new toners into the processing unit. Thus, toner container 12 must be replaced with a new container. For disengagement of the container 12 from the casing 22, the container 12 is slidingly moved in a direction opposite the engaging direction for disengaging the projections 16*a*, 16*b*, 16*c*, 16*d* from the first set of holding segments 27*a*, 27*b*, 27*c*, 27*d*. Accordingly, the toner contain can be lifted from the upper end face of the casing 22 of the developing unit 5. However, in this case, the stepped portion 19 of the tongue piece 17 maintains engagement with the stepped portion 32 of the holder segment 31, and therefore, the toner container 12 cannot be any more slidingly moved. Then, the toner container 12 is angularly rotated for applying distortional force to the tongue piece 17. Thus, the tongue piece 17 is cut at the notched portion 18, so that a cut face 18*a* (see FIG. 7(*c*)) is provided. Consequently, the major portion of the tongue piece remains in the hole 31*a* as best shown in FIG. 7(*c*), whereas the empty toner container 12 can be separated from the developing unit 5 as shown in FIG. 6.

For engaging a new toner container with the developing unit 5, since the major part of the tongue piece 17 remains in the one holding segment 31, a tongue piece of the new toner container is inserted into the other holding segment 30. Then, the same procedure is conducted for the toner supply into the developing unit 5.

The printing times meeting with the amount of the toners supplied by two toner containers is coincident with the available printing times given by the other components such as the photosensitive drum, and volume of the cleaning unit. Therefore, if toners are almost used up, and if the second toner container 12 is also separated from the developing unit 5, the two holder segments 30 and 31 respectively retain therein the major parts of the tongue pieces 17 of the first container 12 and 17 of the second container 12. Thus, it is impossible to replace the second toner container with a third toner container. Accordingly, the processing unit including the developing unit 5 is replaced with a new processing unit in accordance with an operation manual or a display, indicative of the replacement, of the image recording apparatus.

In the first embodiment, since the second set of the holding segments 30 and 31 are positioned at rotationally symmetrical positions, the toner containers can have identical configuration with each other, to thereby use a single metal mold for molding the container, to thus reduce production cost. Further, it is unnecessary to draw specific attention to assembling order of the container with respect to the developing unit 5. Further, it would be advantageous to put such containers in a circulation market because of the unified structure of the containers.

Figure 8:
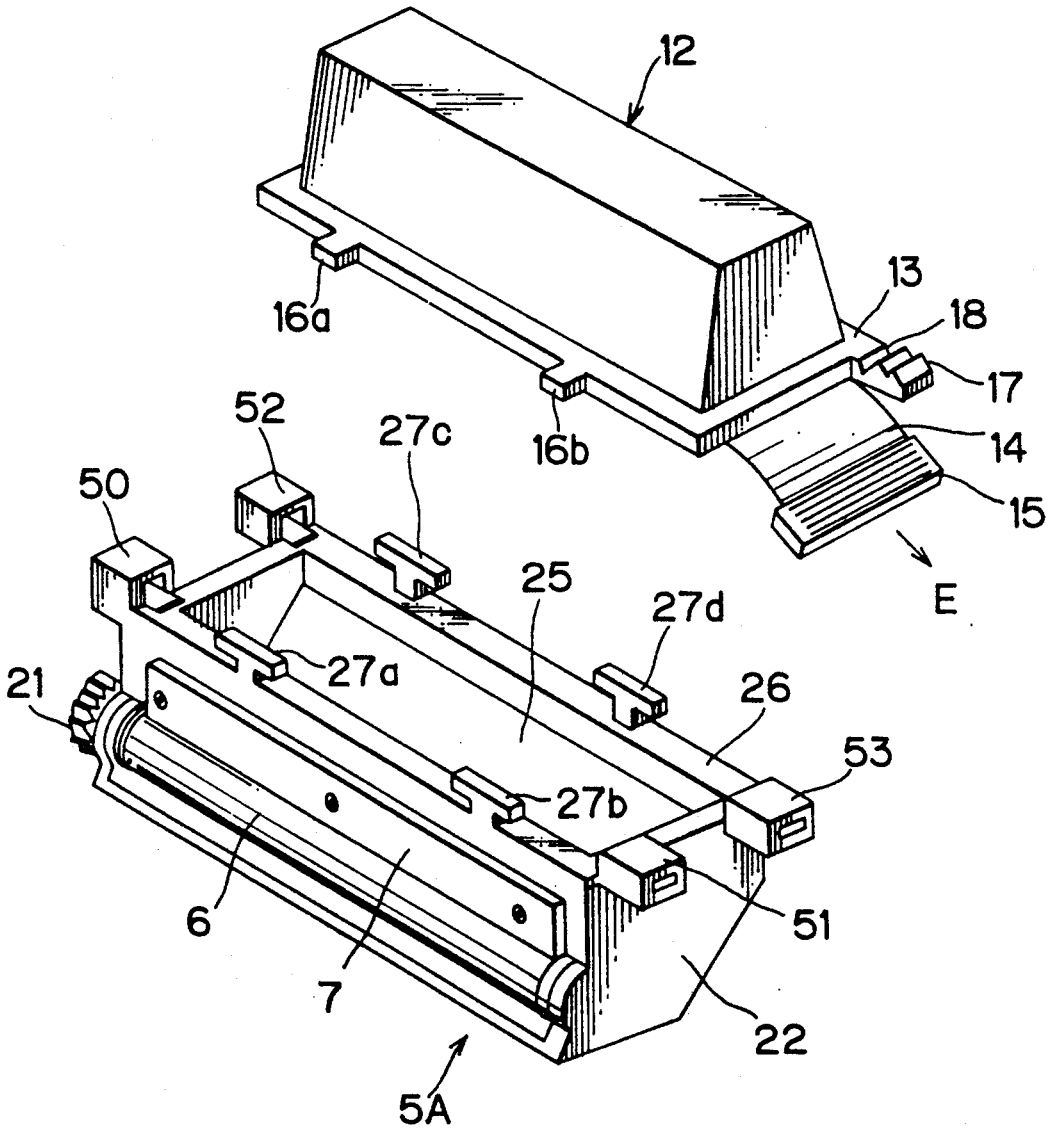
FIG. 8 is a perspective view showing a developer toner container and a developing unit according to a second embodiment of this invention.
Figure 9:
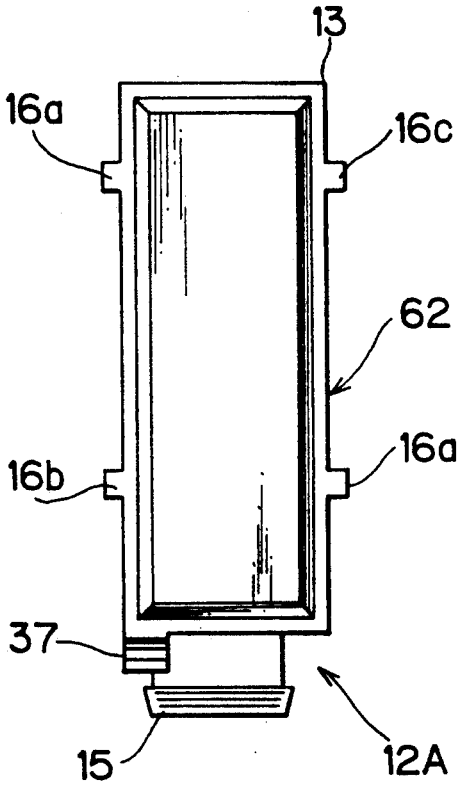
FIG. 9 is a bottom view showing the toner container according to the second embodiment.

Next, a developer material supplying device according to a second embodiment of this invention will be described with reference to FIGS. 8 and 9.

In the second embodiment, a second set of holding segments including four holding segments 50, 51, 52, 53 are provided at corner portions of the upper open end face of the casing 22 of the developing unit 5A. Further, two kinds of developer toner containers 12 and 62 are provided. That is one kind of the containers 12 are the same as the container 12 shown in the first embodiment, and another kind of the containers 62 having tongue piece 37 at a position laterally opposite the tongue piece 17 as shown in FIG. 9. Accordingly, toner supplying work can be done by using the two first kinds of containers 12 and two second kinds containers 62.

Similar to the first embodiment, the tongue 17 can be retainable in the holding segments 50 and 53, and the tongue 37 can be retainable in the holding segments 51 and 52. Therefore, it is impossible to assemble a fifth toner container into the developing unit 5A. Therefore, inadvertent assembly of the toner container into the life-expired processing unit is avoidable.

Figure 10:
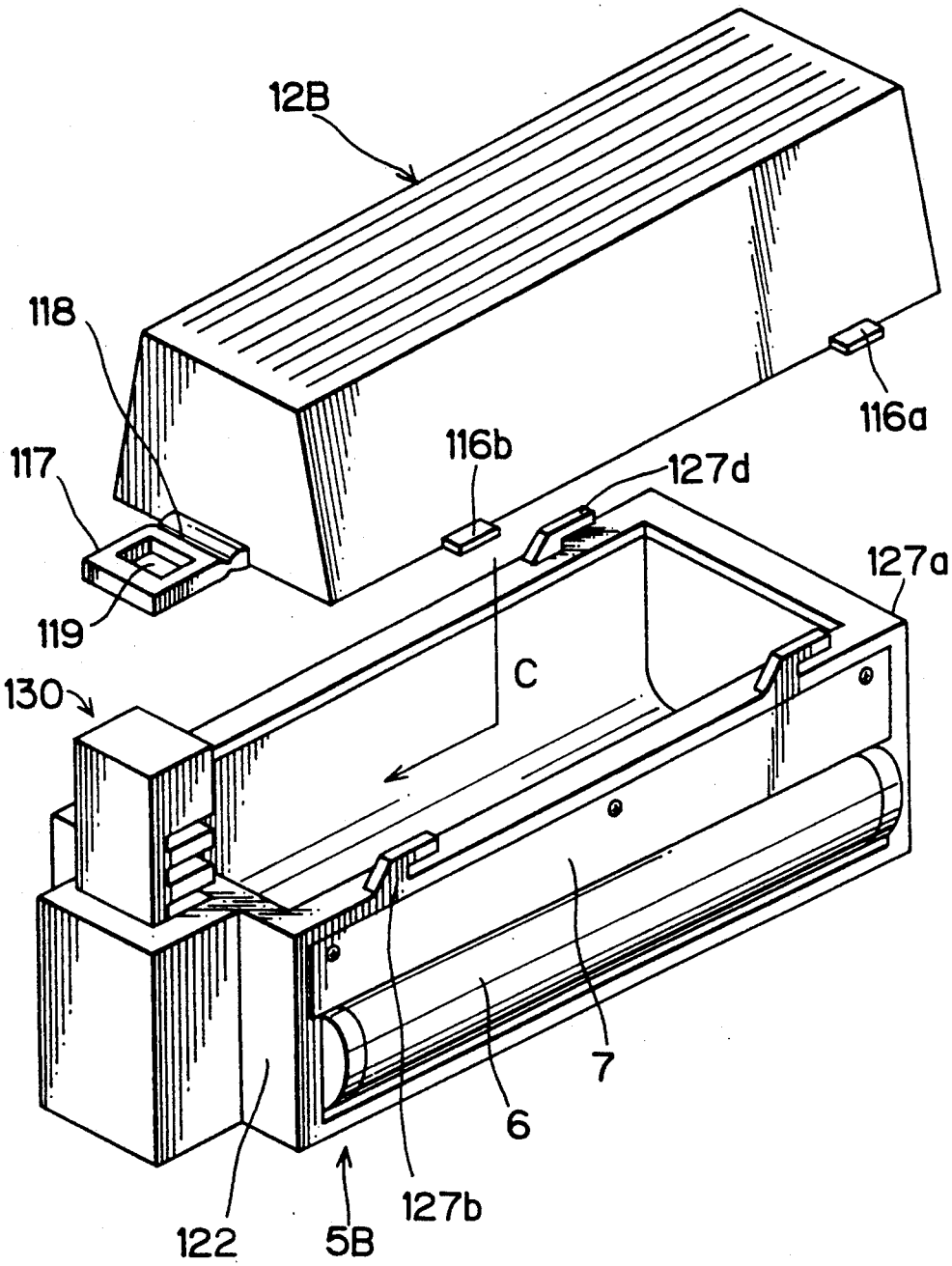
FIG. 10 is a perspective view showing a toner container and a developing unit according to a third embodiment of this invention.
Figure 11:
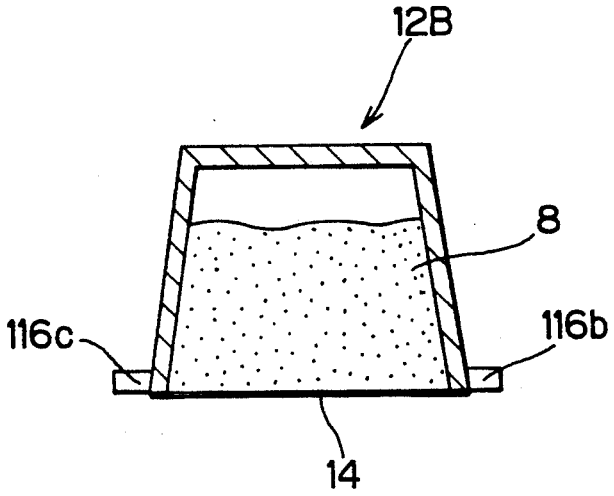
FIG. 11 is a cross-sectional view showing the toner container.
Figure 12:
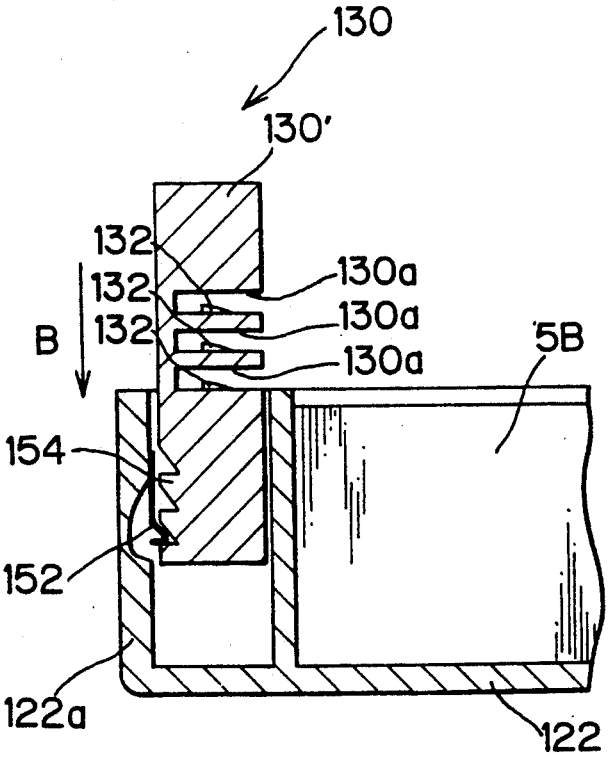
FIG. 12 is a cross-sectional view showing an essential portion of the developing unit according to the third embodiment of this invention.

A developer material supplying device according to a third embodiment of this invention will next be described with reference to FIGS. 10 thru 12, wherein like parts and components are designated by the same reference numerals as those shown in the first embodiment.

A developer toner container 12B includes projections **116*a* through 116*d* similar to the projections 16*a* through 16*d* of the first embodiment. Further, a releasable tongue piece 117 formed with a hole 119 is provided at one minor side of the lower end of the container 12B. A thickness of a base portion of the tongue piece 117 is approximately half of the thickness of the remaining portion thereof, so that the tongue can be cut at a thin portion 118. Further, as shown in FIG. 11, developer toners 8 are sealingly maintained within the container 12B by the sealing film 14** similar to the foregoing embodiments.

Similar to the foregoing embodiments, a casing 122 of the developing unit 5B has an upper end face provided with four holding segments **127*a* through 127*d* engageable with the projections 116*a* through 116*d*. The developing unit 5B is also provided with a second holding segment 130 at a minor side thereof. The second holding segment 130 includes a movable segment 130' and a receiving segment 122*a* provided integrally with the casing 122 of the developing unit 5B. The movable segment 130' is formed with a three fixing recesses 130*a*, 130*a*, 130*a*, each extending in a horizontal direction and positioned one after another in a vertical direction. In each of the fixing recesses 130*a*, an engagement pawl 132 is provided which is engageable with the hole 119 formed in the tongue piece 117**.

The movable segment 130' has a lower portion formed with three one-way protrusions 152. These one-way protrusions 154 are also positioned one after another in the vertical direction. One of the protrusions 154 is engageable with a spring member 152 attached to the receiving segment **122*a*. The engagement between the one-way protrusion and the spring member 152 prohibits the movable segment 130' to be moved upwardly, but allows the movable segment 130' to be moved downwardly as indicated by an arrow B in FIG. 12 because of the resilient deformation of the spring member 152. Thus, the movable segment 130' is slidably movable only in the downward direction relative to the receiving member 122*a*. The movable segment has an uppermost position as shown in FIG. 12 in a market (prior to the assembly of the toner container 12B). Incidentally, the numbers of the fixing recesses 130*a* and the one-way protrusions 154 are indicative of the replaceable times of the toner containers relative to the developing unit 5B**. These numbers are also determinative by the service life of the other components of the processing unit such as the photosensitive drum and the cleaning unit.

With the structure, in the third embodiment, while the movable segment has the uppermost position, the toner container 12B is moved to provide engagement between the projections **116*a* through 116*d* with the first set of holding segments 127*a* through 127*d*. In this case, the tongue piece 117 is inserted into the lowermost fixing recess 130*a*, so that the hole 119 of the tongue piece 119 is brought into engagement with the lowermost pawl 132 positioned in the lowermost fixing recess 130*a*. Thereafter, similar to the foregoing embodiments, the sealing film 14 is peeled off from the lower end face of the container 12B for falling down the toners 8 into the casing 122 of the developing unit 5B**.

For replacing the new toner container 12B with the container 12B, the movable segment 130' is manually pushed down until the spring 152 is brought into engagement with the intermediate one-way projection 154. By the downward movement of he movable segment 130', the tongue piece 117 is cut at the thin portion 118, so that the tongue piece is remained in the lowermost fixing recess **130*a*. Further, an intermediate fixing recess 130*a* is brought to a position in alignment with the next tongue piece of the next toner container 12B. Accordingly, the second toner container can be fixed to the developing unit 5B** in a manner similar to the first toner container.

If toner containers 12B are replaced thrice, each of the fixing recesses **130*a* houses therein the cut tongue piece 117, and the three fixing recesses are fully sunk into the receiving member 122*a*. Therefore, it is possible to prevent a fourth toner container to be assembled into the developing unit 5B. Moreover, the lowermost position of the movable member 130' is indicative of replacement timing of the processing unit. In the third embodiment, the toner containers 12B can have an identical shape, since the position of the tongue piece 117** is positioned at a given single position.

Figure 13:
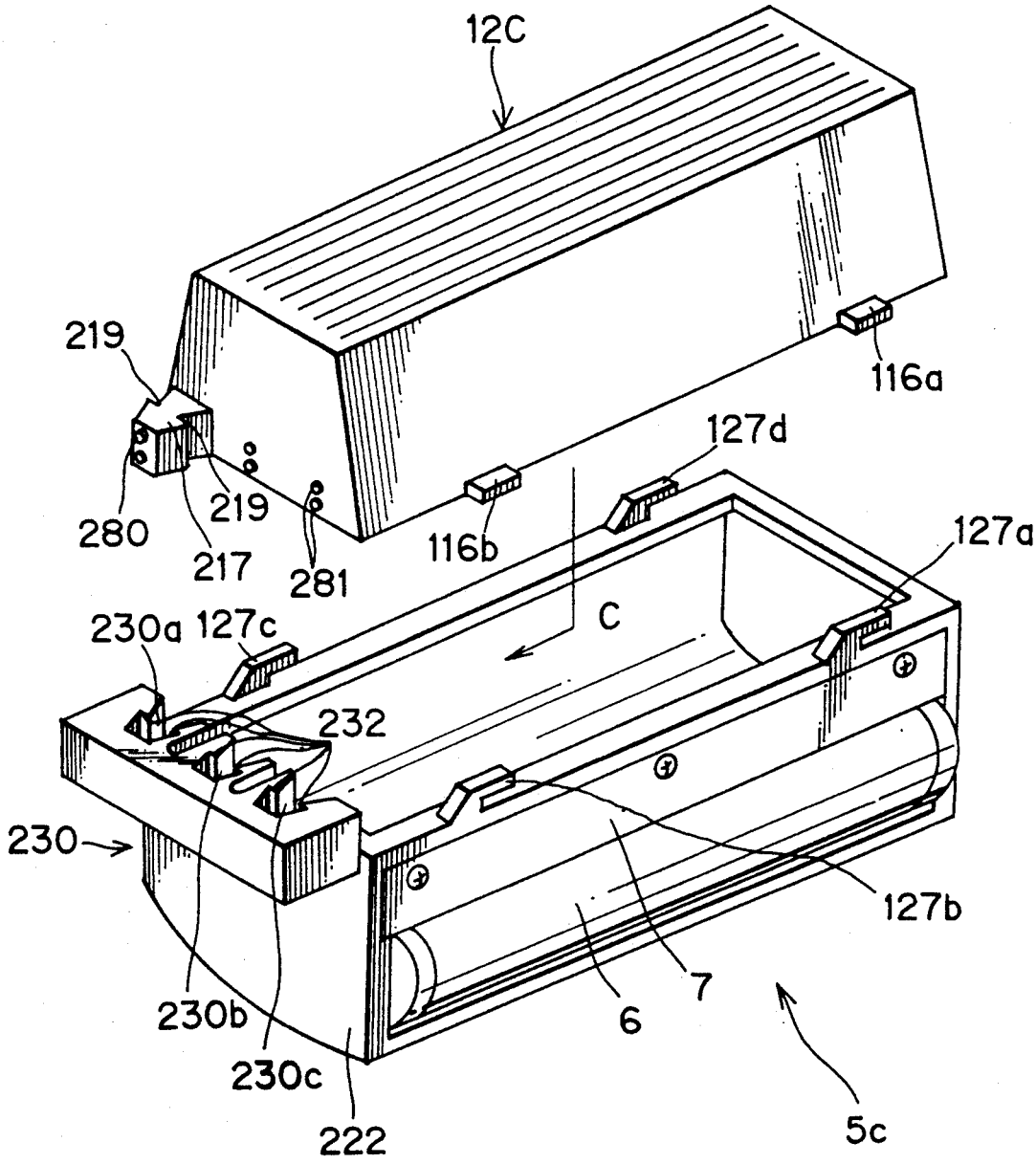
FIG. 13 is a perspective view showing a toner container and a developing unit according to a fourth embodiment of this invention.
Figure 14A:
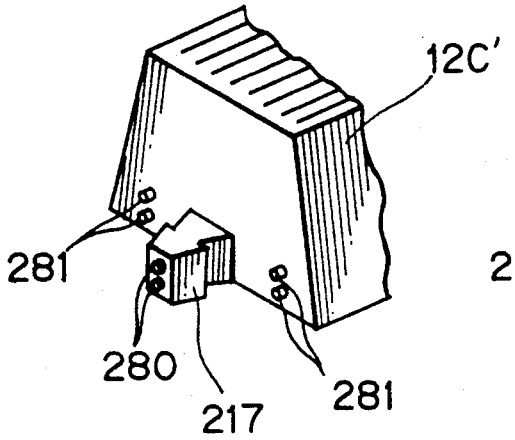
FIGS. 14(*a*) and 14(*b*) show a partial perspective views showing a minor side portion of the toner containers according to the fourth embodiment.
Figure 14B:
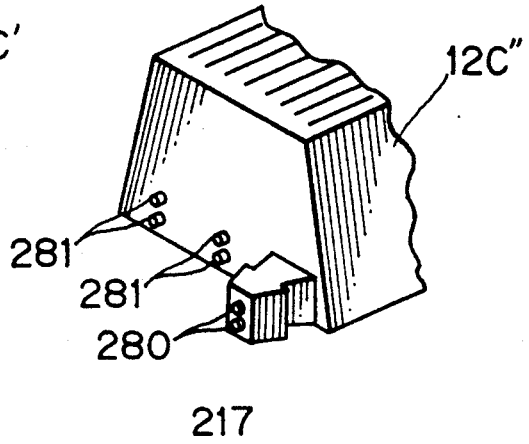

Next, a developer material supplying device according to a fourth embodiment of this invention will be described with reference to FIGS. 13 thru 14(*b*). Three toner containers 12C 12C' and 12C'' are provided each having a tongue piece 217 at minor side thereof. Attaching position of the tongue pieces 217 are different from one another as shown. Each of the tongue pieces 217 has a trapezoidal head in which a length of a top side of the trapezoid is smaller than a base side thereof. Each of the tongue pieces 217 is formed with stepped portions 219 and a pair of holes 280.

On the other hand, three set of a pair of pins 281 extend from the minor side of the toner container 12C, 12C' 12C'', so that the selected pair of the pins 281 are engageable with the pair of holes 280 of the tongue piece 217. After this engagement, tip ends of the pins are thermally fused to provide tight bonding between the pins 281 and the holes 280. Thus, three kinds of toner containers 12C, 12C' and 12C'' are provided in which a position of the tongue piece 217 is positioned at one end, an intermediate portion and another end of the minor side of the containers. Even though two set of the pair of pins are not used, this construction is advantageous in that a metal mold is available for producing the toner container. The non-used two set of the pair of pins can be easily fractured and removed from the toner container. A developing unit 5C is provided with a holding segment 230 at an upper open end face and at a minor side of a casing 222. The holding segment 230 is formed with three engagement recesses 230*a*, 230*b* and 230*c* engageable with the tongue piece 217. Each of the holes has a stepped portion 232 to avoid disengagement of the trapezoidal head of the tongue piece 217 from the hole 230*a*, 230*b*, 230*c*.

With the structure, the toner container is installed on the developing unit 5C in a direction indicated by an arrow C. Therefore, the tongue piece 217 is engaged with the engagement recess 230*a* and the projections 116*a* through 116*d* are engaged with the holding segments 127*a* through 127*d*. In this case, because of the abutment between the stepped portions 219 and the 232, the tongue piece 217 cannot be any more disengaged from the holding segment 230 in case of the horizontal movement of the toner container 12C. Thus, when pulling the toner container 12C in a direction opposite the direction C, the tongue piece 219 is separated from the toner container 12C, and remained in the engagement recess 230*a*. The same is true with respect to the second toner container 12C' relative to the intermediate engagement recess 230*b* and the third toner container 12C'' relative to the other engagement recesses 230*c*. Thus, all recesses 230*a*, 230*b*, 230*c* are occupied by the tongue piece 217, so that it becomes impossible to assemble a fourth toner container into the developing unit 5C.

Figure 15:
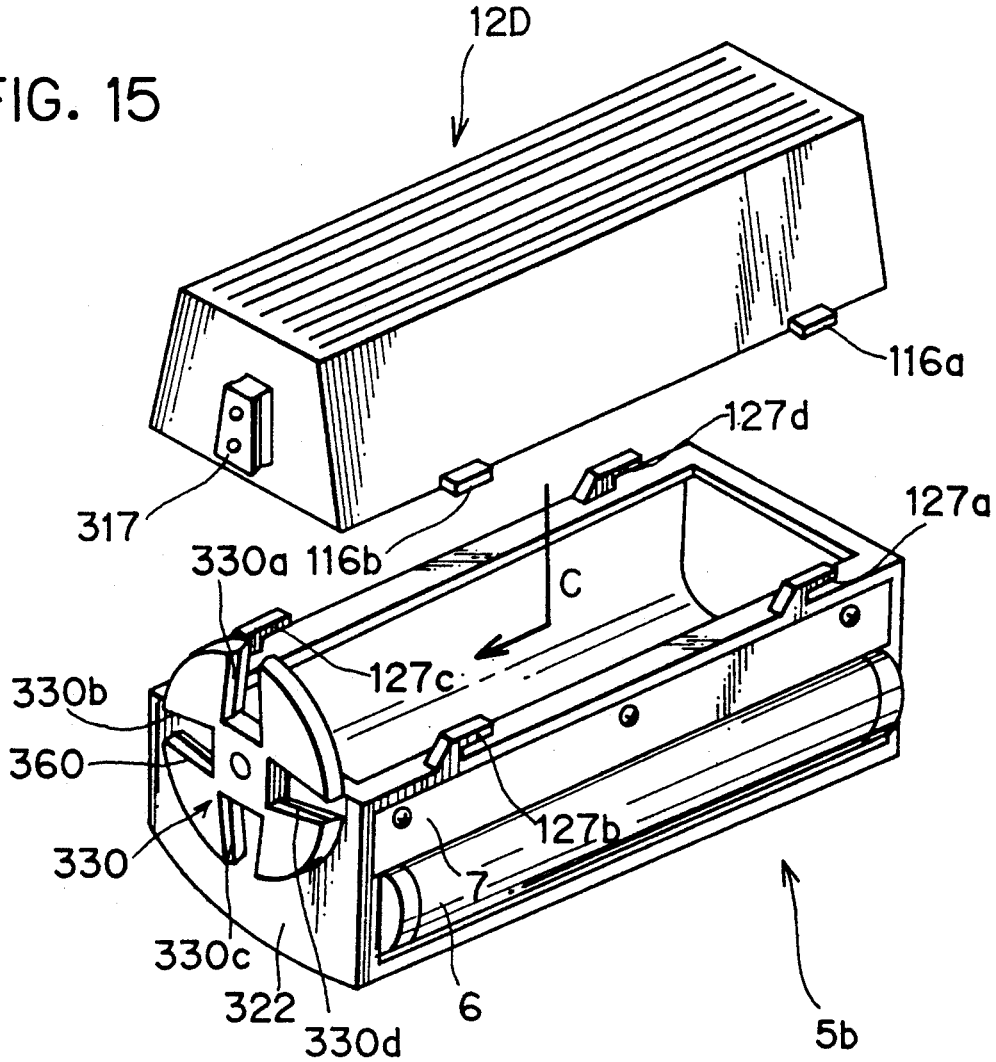
FIG. 15 is a perspective view showing a toner container and a developing unit according to a fifth embodiment of this invention.
Figure 16:
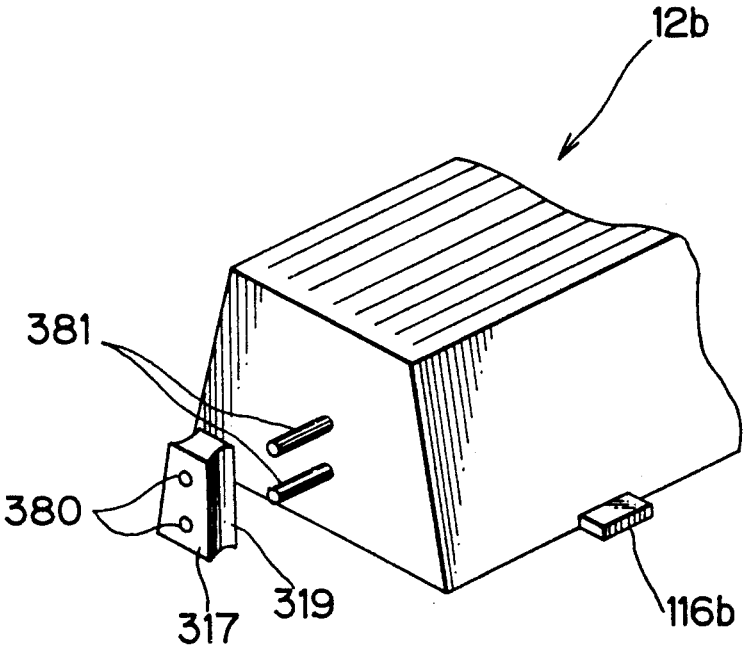
FIG. 16 is an exploded partial perspective view showing the toner container according to the fifth embodiment.
Figure 17:
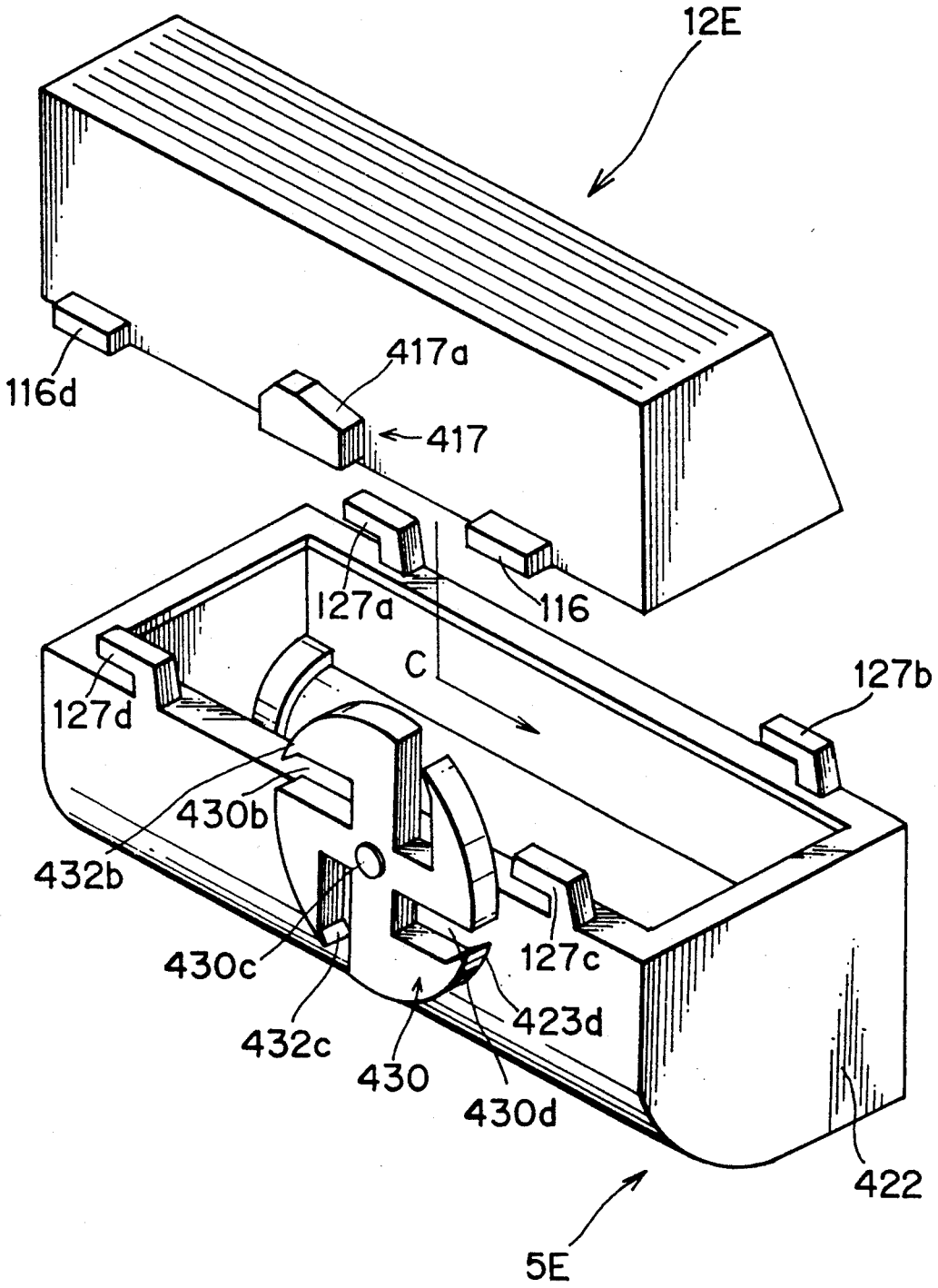
FIG. 17 is a perspective view showing a toner container and a developing unit according to a sixth embodiment of this invention.

Next, a developer material supplying device according to a fifth embodiment of this invention will be described with reference to FIGS. 15 and 16. The fifth embodiment includes a toner container 12D whose minor side is provide with a separable segment 317. As best shown in FIG. 16, two pins 381 extend from the minor side for engagement with corresponding holes 380 formed in the segment 317. The tip ends of the pins 381 are thermally fused for bonding to the separable segment 317. Thus, the separable segment is secured to the minor side of the toner container 12D. As shown in FIG. 17, two vertical sides of the separable segment 317 is formed with arcuate recessed grooves 319.

On the other hand, a developing unit 5E has a casing 322 whose minor side is rotatably provided with a holding wheel segment 330. The wheel 330 is formed with preferably four radial slots 330*a* thru 330*d* equidistantly spaced with each other. The invention, however, is applicable to two slots. The wheel 330 is rotatable about a shaft 360. Each of the radial slots 330*a* thru 330*d* has a protruded parts protruded at a thickness-center of the wheel 330. Therefore, the recessed groove 319 of the separable segment 317 is in mating engagement with one of the radial slots 330*a* thru 330*d*. In other words, one the separable segment 317 is brought into engagement with the slot, it would be almost difficult to disengage the segment from the slot.

With this arrangement, the toner container 12D is installed on the developing unit 5D by the engagement between the projections 116*a* thru 116*d* and the holding segments 127*a* thru 127*d*, and the engagement between the separable segment and one of the radial slots of the holding wheel segment 130 by moving the toner container in the direction C with respect to the stationary developing unit 5D. If the toner container 12D is moved in the direction opposite the direction C, the pins 381 are broken, so that the separable segment remains in the engaging slot. For installing a second toner container on the developing unit 5D, the holding wheel segment 330 is angularly rotated by 90 degrees, so that a next radial slot is brought to a position in alignment with the separable segment of the next toner container.

Thus, if four radial slots 330*a* thru 330*d* are filled with the separable segments 317, it is no longer possible to install a fifth toner container onto the developing unit 5E. According to this embodiment, only a single kind of the toner container is required, to thereby facilitate production thereof.

FIG. 17 shows a developer material supplying device according to a sixth embodiment of this embodiment. Similar to the fifth embodiment, the device includes the separable segment 417 and the holding wheel segment 430. However, the separable segment 417 is attached to a major side of the toner container 12E, and the wheel segment 430 is rotatably provided at a major side of the developing unit 5E. For facilitating the engagement of the separable segment 417 with one of radial slots 430*a*, 430*b*, 439*c*, 439*d*, the separable segment 417 has a slanted top wall 417. Further to prevent the separable segment 417 from being disengaged from the slot, an open end of each of the slots is provided with a locking projection 432*a*, 432*b*, 432*c* and 432*d*.

As described above, according to the present invention, it is possible to positively avoid assembly of a new developer toner container into the life-expired processing unit which is provided with the developing unit. Accordingly, are avoidable image recording operation with degraded photosensitive drum, inoperable cleaning operation due to full accumulation of the waste toners in the cleaning unit and contamination to the image recording apparatus and printing sheet by the waste toners leaked from the cleaning unit. Accordingly, the maintenance to the processing unit can be facilitated, and prolonged service life of the image recording apparatus results because of timely replacement of the processing unit.

While the invention has been described in detail and with reference to specific embodiment thereof, it would be apparent to those skilled in the art that various changes and modifications may be made therein without departing from the spirit and scope of the invention.

What is claimed is:

1. A developer material supplying device for supplying a developer material to a processing unit available for electrophotographic printing, the processing unit having an outer frame for accommodating therein a photosensitive drum having a given service life, a developing unit and a cleaning unit having a service life approximately the same as that of the photosensitive drum, the supplying device comprising:

a developer material container replaceably coupled to the developing unit for supplying the developer material to the developing unit, a number of developer material container replacements being determinative by the service life of the photosensitive drum and the cleaning unit;

fixing means for fixing the developer material container to the developing unit;

an engagement segment provided on the developer material container, the engagement segment being separable from the container upon application of a force, wherein the engagement segment comprises a tongue piece extending from one lateral side of the container in a longitudinal direction thereof, the torque piece having a stepped portion and a notched portion; and receiving means fixed to the developing unit, the receiving means being engageable with the engagement segment when the developer material container is fixed to the developing unit, and the engagement segment being separable from the developer material container and remainable within the receiving means when the developer material container is disassembled from the developing unit, wherein the receiving means comprises at least two holding segments, provided at rotationally symmetrical positions with respect to a center of the developing unit, each segment being formed with a locking hole and having a second stepped portion, the locking hole extending in a longitudinal direction of the developing unit, the stepped portion of the tongue piece being unreleasably engageable with the second stepped portion of the locking hole, and the tongue piece being fractured at the notched portion.

2. The developer material supplying device as claimed in claim 1, wherein the fixing means comprises at least two projections extending from a lower edge portion of the developer material container and at least two holding segments provided at an upper edge portion of the developing unit, the projections being engageable with the holding segments when the developer material container is placed on the developing unit.

3. A developer material supplying device for supplying a developer material to a processing unit available for electrophotographic printing, the process unit having an outer frame for accommodating therein a photosensitive drum having a given service life, a developing unit and a cleaning unit having a service life approximately the same as that of the photosensitive drum, the supplying device comprising:

a developer material container replaceably coupled to the developing unit for supplying the developer material to the developing unit, a number of developer material container replacements being determinative by the service life of the photosensitive drum and the cleaning unit;

fixing means for fixing the developer material container to the developing unit;

an engagement segment provided on the developer material container, the engagement segment being separable from the container upon application of a force, wherein the engagement segment comprises a tongue piece extending from one lateral side of the container in a longitudinal direction thereof, the tongue piece having a stepped portion and a notched portion; and receiving means fixed to the developing unit, the receiving means being engageable with the engagement segment when the developer material container is fixed to the developing unit, and the engagement segment being separable from the developer material container and remainable within the receiving means when the developing unit, wherein the receiving means comprises four holding segments which are positioned at corner portions of the developing unit and extend in a longitudinal direction thereof, each segment being formed with a locking hole and having a second stepped portion, the locking hole extending in a longitudinal direction of the developing unit, the stepped portion of the tongue piece being unreleasably engageable with the second stepped portion of the locking hole, the tongue piece being fractured at the notched portion.

4. The developer material supplying device as claimed in claim 3, wherein the fixing means comprises at least two projections extending from a lower edge portion of the developer material container and at least two holding segments provided at an upper edge portion of the developing unit, the projections being engageable with the holding segments when the developer material container is placed on the developing unit.

5. A developer material supplying device for supplying a developer material to a processing unit available for electrophotographic printing, the processing unit having an outer frame for accommodating therein a photosensitive drum having a give service life, a developing unit and a cleaning unit having a service life approximately the same as that of the photosensitive drum, the supplying device comprising:

a developer material container replaceably coupled to the developing unit for supplying the developer material to the developing unit, a number of developer material container replacements being determinative by the service life of the photosensitive drum and the cleaning unit;

fixing means for fixing the developer material container to the developing unit;

an engagement segment provided on the developer material container, the engagement segment being separable from the container upon application of a force, wherein the engagement segment comprises a tongue piece extending from one side of the container in a longitudinal direction thereof, the tongue piece being formed with a hole and a notched portion; and receiving means fixed to the developing unit, the receiving means being engageable with the engagement segment when the developer material container is fixed to the developing unit, and the engagement segment being separable from the developer material container and remainable within the receiving means when the developer material container is disassembled from the developing unit, wherein the receiving means comprises a receiving segment provided integrally with the developing unit and a movable segment vertically movably supported in the receiving segment, the movably segment being formed with at least two engagement recesses engageable with the tongue piece, a vertical position of the engagement recesses being changed for aligning one engagement recess with the tongue piece.

6. The developer material supplying device as claimed in claim 5, wherein each of the engagement recesses is provided with a protrusion unreleasably engageable with the hole of the tongue piece.

7. The developer material supplying device as claimed in claim 6, wherein the receiving means further comprises a vertical position setting means for determining a vertical position of the engagement recesses in alignment with the tongue piece when the developer material container is coupled onto the developing unit, the vertical position setting means allowing the movable segment to move downwardly but preventing the movable segment from being moved upwardly.

8. The developer material supplying device as claimed in claim 7, wherein the fixing means comprises at least two projections extending from a lower edge portion of the developer material container and at least two holding segments provided at an upper edge portion Of the developing unit, the projections being engageable with the holding segments when the developer material container is placed on the developing unit.

9. A developer material supplying device for supplying a developer material to a processing unit available for electrophotographic printing, the processing unit having an outer frame for accommodating therein a photosensitive drum having a given service life, a developing unit and a cleaning unit having a service life approximately the same as that of the photosensitive drum, the supplying device comprising:

a developer material container replaceably coupled to the developing unit for supplying the developer material to the developing unit, a number of developer material container replacements being determinative by the service life of the photosensitive drum and the cleaning unit;

fixing means for fixing the developer material container to the developing unit;

an engagement segment provided on the developer material container, the engagement segment being separable from the container upon application of a force, wherein the engagement segment comprises a tongue piece extending from one side of the container in a longitudinal direction thereof, the tongue piece having a trapezoidal head portion; and receiving means fixed to the developing unit, the receiving means being engageable with the engagement segment when the developer material container is fixed to the developing unit, and the engagement segment being separable from the developer material container and remainable within the receiving means when the developer material container is disassembled from the developing unit, wherein the receiving means comprises a casing integral to the developing unit, he casing being formed with at least two engagement recesses arranged side by side in a lateral direction of the developing unit for engagement with the tongue piece, each of the engagement recesses being formed with a stepped portion engageable with the trapezoidal head, and wherein the developer material supplying device further comprises:

at least two sets of pin pairs extending from the developer material container, a selected one of the pin pair sets supports the tongue piece, and non-selected pin pair sets are fractured when assembling the developer material container into the developing unit, and wherein the pin pair sets are positioned in corresponding alignment across from the engagement recesses.

10. A developer material supplying device for supplying a developer material to a processing unit available for electrophotographic printing, the processing unit having an outer frame for accommodating therein a photosensitive drum having a given service life, a developing unit and a cleaning unit having a service life approximately the same as that of the photosensitive drum, the supplying device comprising:

a developer material container replaceably coupled to the developing unit for supplying the developer material to the developing unit, a number of developer material container replacements being determinative by the service life of the photosensitive drum and the cleaning unit;

fixing means for fixing the developer material container to the developing unit;

an engagement segment provided on the developer material container, the engagement segment being separable from the container upon application of a force, wherein the engagement segment comprises a separable piece provided at one side of the container; and receiving means fixed to the developing unit, the receiving means being engageable with the engagement segment when the developer material container is fixed to the developing unit, and the engagement segment being separable from the developer material container and remainable within the receiving means when the developer material container is disassembled from the developing unit, wherein the receiving means comprises a rotatable wheel member rotatably supported to the developing unit, the wheel member being formed with at least two radial slots engageable with the separable piece when the developer material container is placed on the developing unit, an engagement force between the separable piece and the slots being greater than a connecting force between the separable piece and the container.

11. The developer material supplying device as claimed in claim 10, wherein the developer material container has two major sides and two minor sides, the separable piece being secured to one of the minor sides, and wherein the developing unit has two major sides and two minor sides, the wheel member being positioned at one of the minor sides of the developing unit.

12. The developer material supplying device as claimed in claim 10, wherein the developer material container has two major sides and two minor sides, the separable piece being secured to one of the major sides, and wherein the developing unit has two major sides and two minor sides, the wheel member being positioned at one of the major sides of the developing unit.

* * * * *